United States Patent [19]

Connell

[11] 4,241,349

[45] Dec. 23, 1980

[54] APPARATUS FOR DISPOSING CORNER CUBE REFLECTOR FOR DETECTION

[75] Inventor: John L. Connell, San Francisco, Calif.

[73] Assignee: Davis Instruments Corporation, San Leandro, Calif.

[21] Appl. No.: 19,191

[22] Filed: Mar. 9, 1979

[51] Int. Cl.[3] ..... H01Q 15/18

[52] U.S. Cl. ..... 343/18 C

[58] Field of Search ..... 343/18 C

[56] References Cited

U.S. PATENT DOCUMENTS 3,451,060 6/1969 Edwards ..... 343/18 C

*Primary Examiner*—T. H. Tubbesing

*Attorney, Agent, or Firm*—Townsend and Townsend

[57] ABSTRACT

In a corner cube radar reflector of the octahedral radar reflector cluster type wherein three planar radar reflecting plates are orthogonally disposed all in planes of non-coincidence to the horizon, an improved holder is disclosed. Typically first and second tapered members are conformed to the apexes of upwardly and downwardly opposed corner cubes with the upper cube in the "catch rain" position. The tapered members are urged one towards another and fastened to a vertical support, which support can either be rigid or alternatively tensive. There results a support for the reflector in which the designed corner cubes are addressed with optimum solid angle disposed to the horizon from which radar interrogation will most probably occur.

13 Claims, 8 Drawing Figures

APPARATUS FOR DISPOSING CORNER CUBE REFLECTOR FOR DETECTION

Figure 1:
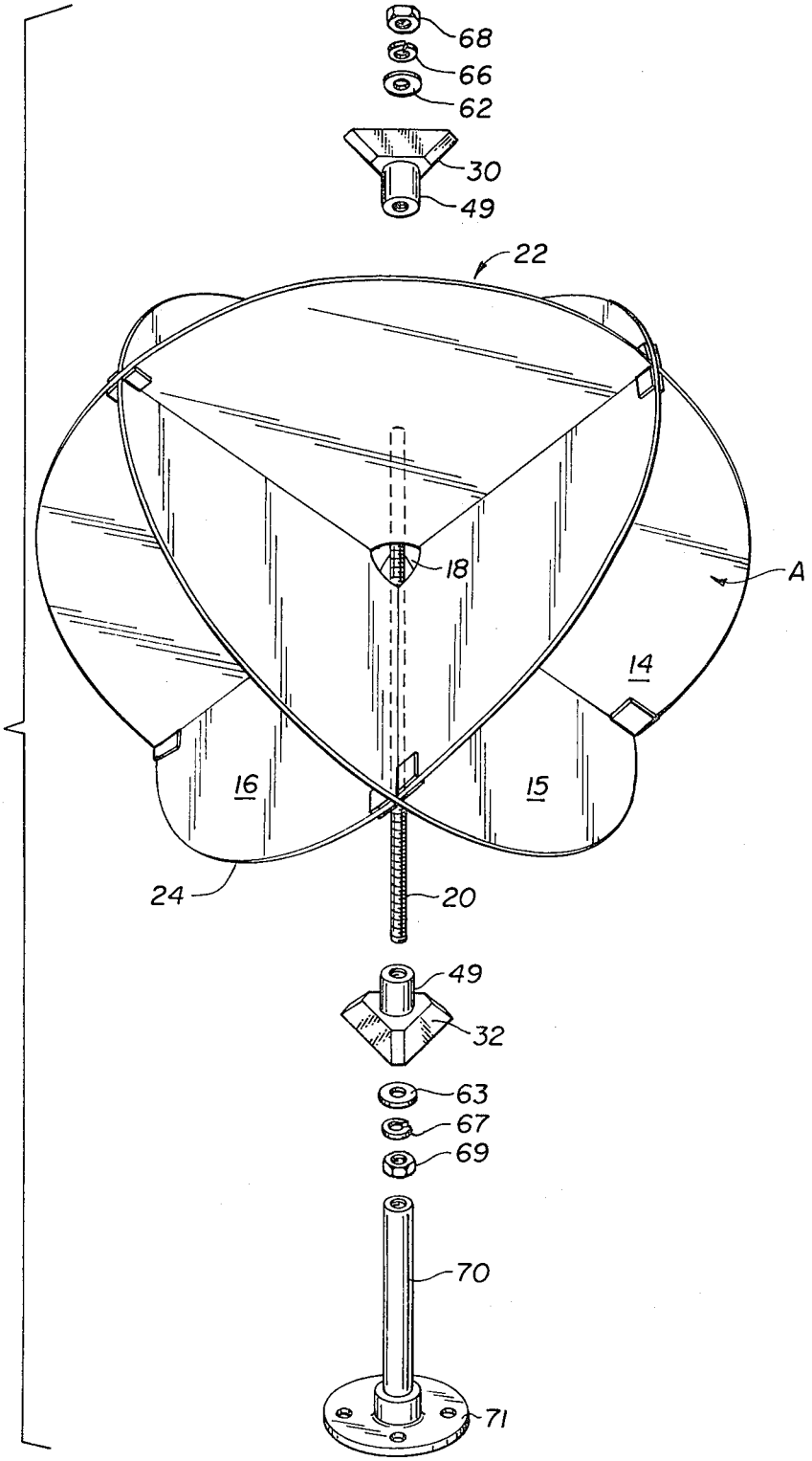

This invention relates to radar reflectors and more particularly to a simplified mount for a corner cube type radar reflector in which optimum address of the corner cubes of an octahedral radar reflector cluster occurs to the horizon from which radar interrogation usually occurs.

SUMMARY OF THE PRIOR ART

Corner cube radar reflectors are known. Specifically, eight corner cubes are usually designed by arraying three separate planar radar reflecting plates, one with respect to another. There results eight corner cubes.

The property of a corner cube is prior art and may be easily understood. Specifically, it is a property of a corner cube reflector to retroreflect precisely perpendicular to the angle of incidence radiation received to an exposed corner cube. This configuration is particularly desirable in an array. By disposing the corner cube so that all three surfaces can be seen by incident radiation, precisely parallel retroreflection and hence detection is assured.

Radar reflectors of the corner cube type, however, are definitely not as effective when one of the three radar reflecting surfaces is disposed parallel to the interrogating radiation. In this case, only two of the surfaces of each corner cube have an appreciable solid angle to the incoming radiation and corner cube retroreflection is substantially diminished.

Various schemes have been proposed for the prior art to address corner cube radar reflectors for interrogation. Such schemes have included holding the surfaces of the discs at spaced intervals. Unfortunately, such suspension tends to bend the surfaces out of their mutually perpendicular array and thus destroy the effectiveness of the corner cube. In conditions experienced by small boats at sea, such distortion can occur to the point where the radar reflector is broken apart.

SUMMARY OF THE INVENTION

In a corner cube radar reflector of the octahedral radar reflector cluster type wherein three planar radar reflecting plates are orthogonally disposed all in planes of non-coincidence to the horizon, an improved holder is disclosed. Typically first and second tapered members are conformed to the apexes of upwardly and downwardly opposed corner cubes with the upper cube in the "catch rain" position. The tapered members are urged one towards another and fastened to a vertical support, which support can either be rigid or alternatively tensive. There results a support for the reflector in which the designed corner cubes are addressed with optimum solid angle disposed to the horizon from which radar interrogation will most probably occur.

OTHER OBJECTS AND ADVANTAGES

It is an object of this invention to disclose a holder for a corner cube radar reflector of the octahedral cluster type having orthogonally disposed intersecting radar reflecting surfaces. Accordingly, first and second tapered members are disposed with surfaces conforming to a pyramid. The radar reflector itself is cross-bored at opposed corner cubes. A tensive member extends through one tapered member, the boring of the corner cube, and the remaining tapered member. This tensive member urges the two tapered members one towards another to hold the reflector therebetween. By fastening this member to a vertical support, such as a line or vertical rigid rod, mutual support of the radar reflector with its respective corner cubes developed with optimum solid angle to the horizon occurs.

An advantage of the support of this invention is that it typically reinforces such radar reflectors. Specifically such radar reflectors are typically shipped to the consumer in a condition and assembled by the consumer in a permanent mounted array. Maintaining the discs mutually orthogonal is accomplished by fastening the discs at points of intersection. By the expedient of using the exposed tapered members of this invention to hold the reflector, not only is support provided but surreptitious reinforcement of the corner cube array results.

A further object of this invention is to disclose a permanent mount for a radar reflector. Accordingly, two three-sided pyramids are disposed with their apexes coincident. The apexes of the pyramids are truncated, and a spacer member inserted so that the truncated pyramids are still maintained with a spacing wherein their apexes would be coincident, but for the truncation. This spacer member is centrally bored so that a fastener, such as a threaded rod, may urge the pyramid portions together. By fastening the truncated pyramids towards one another across a reflector at opposite corner cubes, firm and rigid mounting can occur.

An advantage of the disclosed truncated mount of this invention is that it does not distort the corner cube array. Rather the truncated shape assists the corner cube array in maintaining its shape.

According to another embodiment of this invention, each of the holding members is defined from a first larger elastic cylinder member and second smaller elastic cylinder member. These elastic cylinder members when urged across opposite corner cubes conform to the corner cube surfaces. When these elastic cylindrical members are urged together, either by a threaded rod or line, holding of the reflector in the desired position with surreptitious reinforcement of the corner cube surfaces occurs.

An advantage of the holder of this invention is that the reflector may be simultaneously suspended from a line in a disposition so that the corner cubes mutually address themselves by retroreflection of interrogating radiation to sources disposed about the horizon.

Figure 2A:
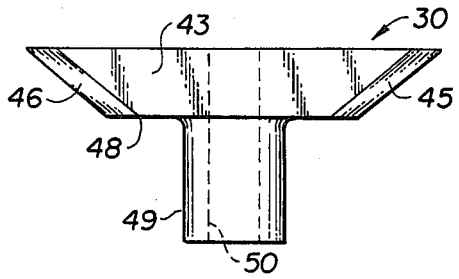
Figure 2B:
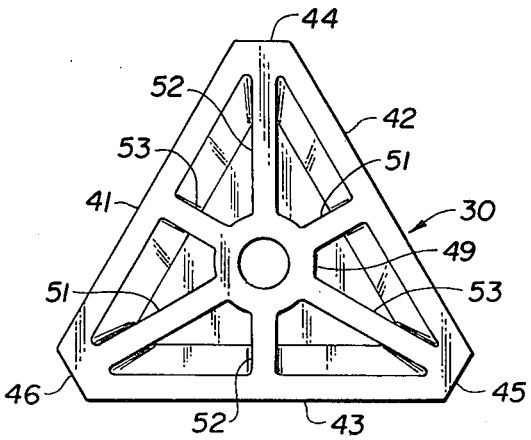
Figure 2C:
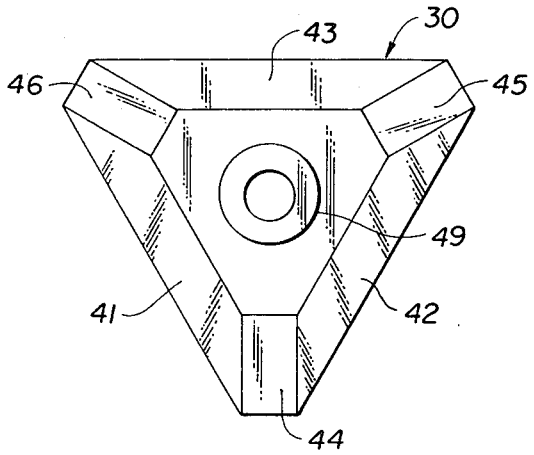
Figure 3:
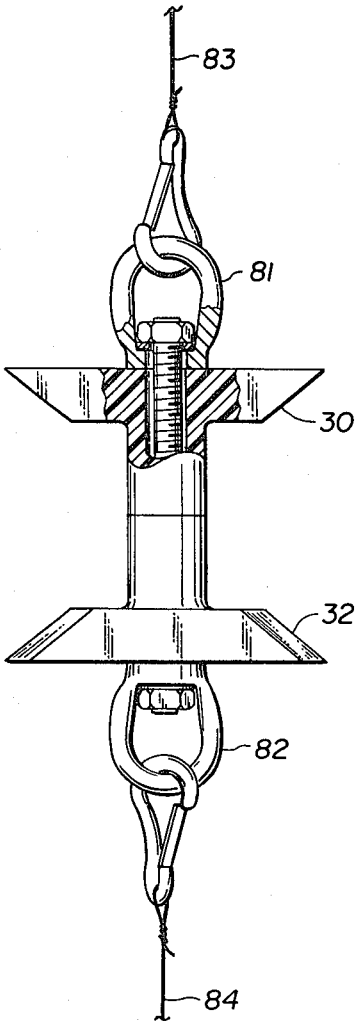
Figure 4A:
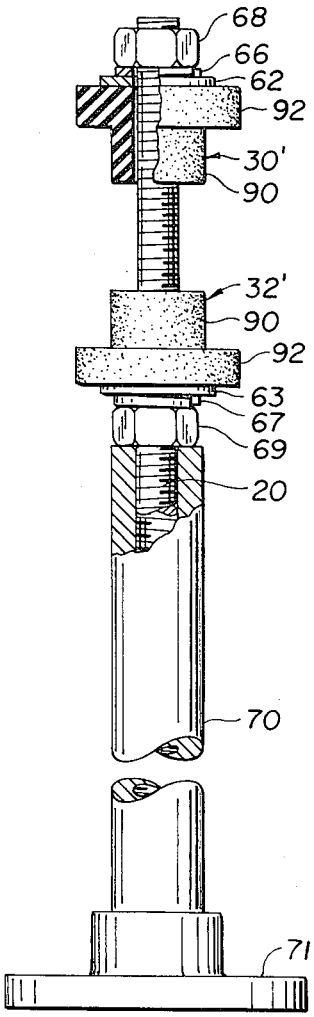
Figure 4B:
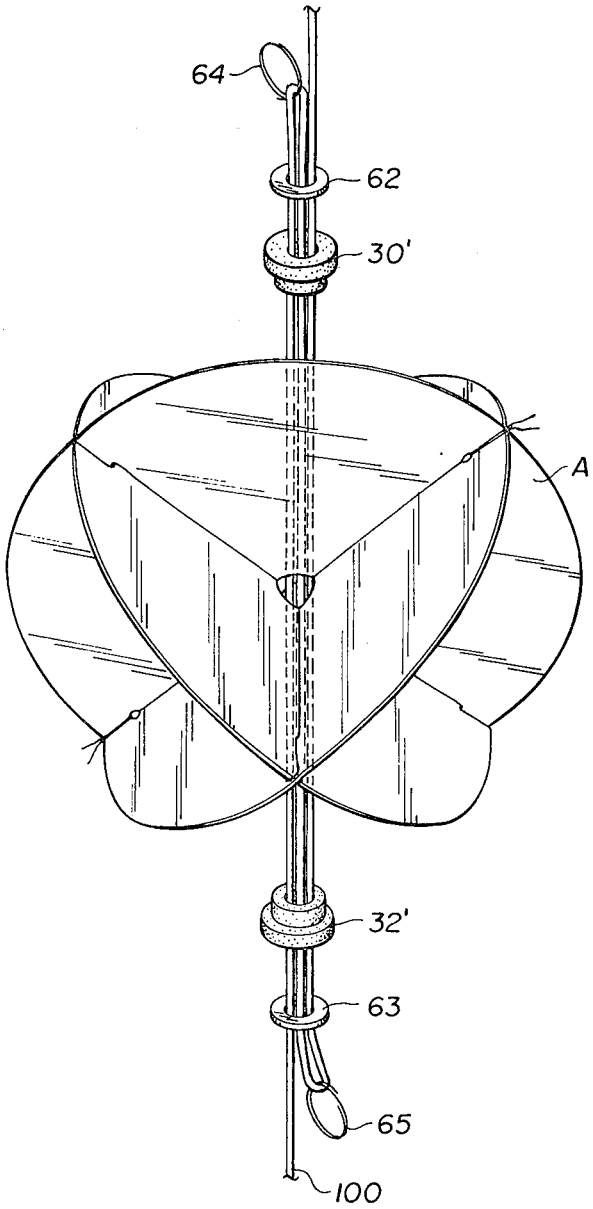
Figure 4C:
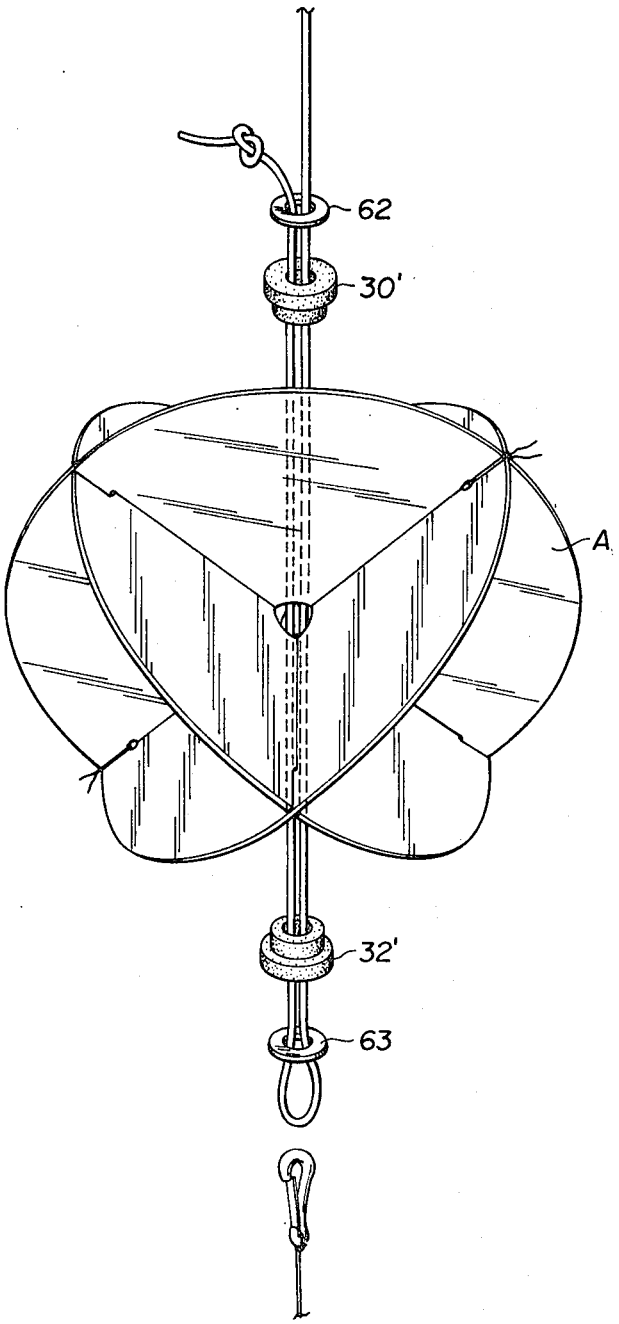

Other objects, features and advantages of this invention will become more apparent after referring to the following specification and attached drawings in which:

FIG. 1 is an exploded perspective view of a hard mounted radar reflector of this invention illustrating the octahedral radar reflecting cluster mounted between paired truncated mountings on a rigid floor flange mount;

FIGS. 2A–2C illustrated the truncated pyramid mounting of this invention;

FIG. 3 illustrates upper and lower bails utilized with the mountings of FIGS. 2A–2C for fastening to a halyard; and FIGS. 4A, 4B, and 4C illustrate alternate embodiments of the mounting member of this invention utilizing conformable rubber cylinders, the embodiment of FIG. 4A illustrating mounting to a threaded rod and the embodiment of FIGS. 4B and 4C illustrating a small line for urging the members one towards another.

Referring to FIG. 1, an octahedral radar reflector cluster A is shown having three circular discs 14, 15, and 16 placed in a mutually orthogonal disposition. Each disc has a circular hole in the center so that disc intersection is defined about an apex 18 providing a point for transpiercing the cluster. The circular holes, by themselves, are frequently considered desirable to reduce wind resistance of the reflector cluster. As will hereinafter become more apparent, a threaded rod 20 transpierces cluster A between two opposed corner cube reflectors. One opposed corner cube reflector 22 faces upwardly and is the opening into which first tapered member 30 fits. A second corner cube reflecting surface 24 is disposed downwardly and is the mounting into which second tapered member 32 fits.

In order to quickly understand the invention, a typical mounting member 30, 32 will be set forth with respect to FIGS. 2A–2C. Thereafter and with return to FIG. 1 and 3, two typical mountings will be set forth.

Turning to FIGS. 2A–2C, a typical member 30 is illustrated comprising a pyramid having three bottom or base sides 41, 42 and 43. These sides are configured at approximately 55 degrees (the angle whose tangent is $\sqrt{2}$) with respect to the base to provide the optimum angle of contact.

Juncture between the base edges are provided with tapering surfaces 44, 45, and 46. These surfaces are tapered at an angle of approximately 35 degrees (the angle whose cotangent is $\sqrt{2}$) with respect to the base and provide clearance for dimples at the plate intersections, said dimples being commonly pressed into the metal plates for locating and strengthening purposes in those cases where plates are free to be assembled and disassembled.

The pyramid is truncated as at 48. Extending upwardly from the truncated portion of the pyramid is a spacer member 49 which is cross-bored at a bore 50. This cross-boring, as will be more apparent hereinafter, permits a threaded rod to pass thereto. The rod functions in holding two pieces identical to the piece 30 illustrated in FIGS. 2A–2C towards one another to hold the radar reflector of this invention.

In accordance with standard practice, cylindrical member 49 extends through the entire base. It is suitably reinforced with identical web members 51, 52 and 53, each of these web members being interrupted at the cylindrical member 49.

Having set forth the configuration, its operation can be readily understood.

Overlying the truncated member 30, is washer 62, lock washer 66, and nut 68. Similarly, underlying tapered member 32 there is washer 63, lock washer 67, and nut 69. By the expedient of placing threaded rod 20 through the exploded array to the respective nuts 68, 69 and threading the nuts one towards, another on the rod, secure fastening of the members 30, 32 together occurs.

It will be noted that the protruding cylindrical members 49 will not allow movement of the tapered members 30, 32 completely towards one another. Rather, these members will come into confrontation and prevent such forward movement. This will occur at a point where the truncated apexes of members 30, 32 are almost in registry to the opposed corner cubes 22, 24. This will prevent crushing of the radar reflector by the mechanical leverage of the threaded rod 20 and the respective nuts 68, 69.

Mounting of the rod mounted reflector to a floor flange 71 by standard pipe nipple 70 is easily accomplished. Specifically, nipple 70 is threaded on the outside so as to fit to floor flange 71. The inside of the nipple is threaded to receive rod 20 by rotating the reflector until firm engagement occurs interiorly of threaded nipple 70. Alternatively the rod and nipple can be pinned or cemented together. A hard mounting occurs.

It should be understood that the vertical mount here illustrated is preferred. However, in the case of some sailboats, where tacking at an angle to the wind oft times occurs, the mounting herein can be disposed forwardly fore and aft and parallel to the horizon. The result can be a mounting which disposes reflector most suitably for retroreflection in the fore end aft directions, and eliminates in these directions the deleterious effect of boat heeling, and which mounting is well-known as the "yachting position" and which is also perfectly supported by this invention.

Referring to FIG. 3, paired members 30, 32 are each shown with a bail 81, 82 disposed between the lock washer and nut and substituted for the respective flat washer 62, 63 of FIG. 1. As is plainly illustrated, the respective bails can be fastened by standard knot techniques to upper halyard 83 and lower halyard 84. With such an array, mounting of the reflector to a line easily occurs.

Tensioned between upper and lower halyards attached to bails, the reflector can rotate or oscillate without degradation in performance, and in fact such a degree of freedom may be considered advantageous under most conditions in establishing the best average echo response 360° around the horizon.

Referring to FIG. 4A, an alternate embodiment of the mounting is there shown. It should be understood that this particular mounting finds its optimal use with an emergency reflector made out of fiberboard. In the case of the fiberboard reflector, the bore 18 as illustrated in FIG. 1 is reduced in size so as to pass only small lines or a threaded rod.

Referring to FIG. 4A, opposed units 30' and 32' are illustrated. These respective units consist of small resilient cylinder 90 and large resilient cylinder 92 or may take the more general shape of a truncated right circular cone. Over the outside portion of larger resilient cylinder 92, there is disposed a conventional flat washer 62, lock washer 66 and nut 68. Similarly, and under member 32'there is disposed flat washer 63, lock washer 67 and nut 69. As illustrated in FIG. 4A, threaded rod 20 is threaded within conventional nipple 70 mounted to floor flange 71.

It will be understood that upon tightening of respective nuts 68, 69 that resilient cylinders 90, 92 confront and conform to each of the three mutually intersecting planar and radar reflecting surfaces of the illustrated holder. This being the case, it is expected that the resilient cylinders 90, 92 will be forced into contact with and conform to meet the respective radar reflectors.

It will be appreciated by those having skill in the art, that mounting of the opposed members 30', 32' could as easily be accomplished utilizing a single and continuous line. Referring to FIG. 4B, a line 100 extends upwardly through washer 63 and tapered member 32'. From thence it passes through the cross-bored reflector A up through member 30', washer 62 and around cotter ring 64. Line 100 thence passes again respectively downward through washer 62, tapered member 30', radar reflector A, tapered member 32', washer 63 and then to lower cotter ring 65. The line then repeats in a serpentine configuration through washer 63, tapered member 32', the reflector A, tapered member 30' and up and out through washer 62.

Referring to FIG. 4C, it can be seen that another simple line mounting can be used that also has the necessary property of urging the opposed members, 30', 32' together as upper and lower support halyards are tensioned. Very high friction of lines bending sharply around cotter rings or external hooks sets a natural limit to the inward directed snugging forces, such as to prevent damage to the reflector plates.

It should be appreciated that the illustrated line can either form a portion of the halyard to which the reflector is attached or alternately may be tied off and affixed to the halyard or vessel super structure in any conventional way. Similar to the embodiment illustrated in FIG. 3, pendulous movement of the suspended cluster to the "catch rain" position occurs. This movement can be enhanced by incorporating the holder as part of a halyard.

It is believed apparent that with the line mountings herein illustrated, seamen of ordinary skill can imagine of numerous mountings for the disclosed reflector. Further, tapered members of various configurations can all be utilized with the disclosed invention.

What is claimed is:

1. Apparatus for holding an octahedral radar reflector cluster having eight corner cubes comprising in combination first and second tapered members, each said tapered member confronted across opposing corner cubes to each of the three mutually orthogonal surfaces of a corner cube, said respective tapered members being disposed with their respective constricted ends towards one another; means for urging said respective tapered members towards one another across the apexes of said opposed corner cubes whereby said tapered members are wedged into opposing apexes of said opposed corner cubes; and a vertical support fastened to one of said members.

2. The invention of claim 1 and wherein said vertical support comprises a line.

3. The invention of claim 1 and wherein said vertical support comprises a vertical rod with means attached to said rod for urging said members one towards another.

4. The invention of claim 1 and wherein said respective tapered members include first and second truncated three-sided pyramids, the taper and truncation of said pyramids cooperatively configured to contact each of the three mutually orthogonal surfaces over a discrete area.

5. The invention of claim 4 and including at least one spacer member protruding from the point of truncation of said pyramids for contact with the other of said members for maintaining said truncated pyramid members in spaced apart relation with the truncated apex portions of said pyramids in juxtaposition.

6. An octahedral radar reflecting cluster comprising in combination three planar radar reflecting surfaces all orthogonally disposed about a mutual point of intersection to define eight corner cube arrays; said reflecting orthogonal surfaces cross-bored between at least two opposed corner cubes; first and second tapered members confronted to said mutually opposed corner cube surfaces; and, means extending from one said tapered member to the other said tapered member and across said bore between said opposed corner cubes for urging said respective tapered members one towards one another with said orthogonally disposed reflecting surfaces therebetween; and means attached to one of said members for fastening said member to a vertical support.

7. The invention of claim 6 and wherein each of said tapered members comprises a truncated right circular cone or a first resilient small cylindrical plug with a second resilient larger cylindrical plug, each said plug conformable to the orthogonally intersecting surfaces of said corner cube reflector.

8. The invention of claim 6 and wherein each of said tapered members includes truncated pyramids, said pyramids conforming to the sides of each of said opposed corner cubes of said reflector.

9. The invention of claim 6 and wherein said means for urging said members together includes a line.

10. A radar reflector comprising in combination at least three orthogonally disposed planar surfaces intersecting at a common point to define at least eight corner cubes; first and second tapered members; each said tapered member configured for conforming to the respective three sides of a corner cube approximate the apex thereof; said reflective surfaces as disposed together defining an aperture across opposed corner cubes; means for urging said respective tapered members towards one another across said aperture; and a vertical support for maintaining said opposed members in a vertical disposition.

11. The invention of claim 10 and wherein said vertical support comprises a line.

12. The invention of claim 10 and wherein said vertical support includes a line affixed to one of said members and extending upwardly and a line affixed to the other of said members and extending downwardly.

13. The invention of claim 10 and wherein said support includes a rigid vertical member and means rigidly affixing said vertical member to one of said members so as to dispose said members as urged towards one another to a vertical axis.

* * * * *